US006939024B2

(12) United States Patent
Keller et al.

(10) Patent No.: US 6,939,024 B2
(45) Date of Patent: Sep. 6, 2005

(54) WORK SURFACE LIGHTING

(75) Inventors: Hans Gerd Keller, Sundern (DE); Michael Schindler, Forst (DE)

(73) Assignee: BSH Bosch und Siemens Hausgerate GmbH, Munich (DE)

( * ) Notice: Subject to any disclaimer, the term of this patent is extended or adjusted under 35 U.S.C. 154(b) by 0 days.

(21) Appl. No.: 10/441,589

(22) Filed: May 19, 2003

(65) Prior Publication Data

US 2004/0042210 A1 Mar. 4, 2004

(30) Foreign Application Priority Data

Nov. 21, 2000 (DE) ..... 200 19 737 U

(51) Int. Cl.[7] ..... F21V 23/00

(52) U.S. Cl. ..... 362/295; 362/92; 362/234; 362/251

(58) Field of Search ..... 362/295, 92, 96, 362/234, 251, 89; 126/273, 299; 219/702, 716, 721, 718

(56) References Cited

U.S. PATENT DOCUMENTS 3,834,295 A 9/1974 Seidel
5,252,797 A * 10/1993 Komatsu ..... 219/729
5,690,093 A 11/1997 Schrank et al.
6,222,171 B1 * 4/2001 Fukuda et al. ..... 219/757

FOREIGN PATENT DOCUMENTS

| | | |
|---|---|---|
| EP | 0892221 | 1/1999 |
| EP | 1039235 A2 | 9/2000 |
| GB | 2263334 | 7/1993 |

* cited by examiner

*Primary Examiner*—Sandra O'Shaa
*Assistant Examiner*—Mark Tsidulko
(74) *Attorney, Agent, or Firm*—John T. Winburn; Russell W. Warnock; Craig J. Loest

(57) ABSTRACT

A work surface lighting arrangement for lighting the work surface under an extractor hood, such as a cooking surface in a kitchen area. The lighting arrangement includes at least two lights in the hood with one light being user activated and the second activated by operation of the hood. The lights can include a dimming function and the second light can be activated with the hood exhaust fan. The second light also can be activated only after activation of the first light.

7 Claims, 2 Drawing Sheets

WORK SURFACE LIGHTING

BACKGROUND OF THE INVENTION

Field of the Invention

The invention relates to lighting for a work surface beneath an extractor hood, wherein the lighting means are arranged in the extractor hood, and can be switched on and off by means of a switch.

Such applications are known for the kitchen area, where an extractor hood with lamps is arranged over the cooking surface to light the cooking surface. Lighting normally takes place with two or more lamps actuated via a switch. This switch is located directly on the extractor hood, or linked with the actuation of extraction units from the extractor hood.

The disadvantage to these types of cooking surface lighting means is that the luminous intensity, and hence the power consumption, is constant when switched on, even though this luminous intensity is not continuously required over the period of use. This holds true in particular when the cooking surface lighting is also used for lighting a room independently of cooking.

To resolve this energy problem, U.S. Pat. No. 5, 690,093 proposes a circuit in an extractor hood that makes it possible to regulate the fan speed and luminous intensity within broad limits. This is done by making the appropriate inputs via an array of strips with contact switches on the front of the extractor hood. A diminished nighttime lighting can be set as well.

EP 1 039 235 A2 discloses a cooking surface with extractor hood arranged over it, in which a moving hand or dish turns on the lamps and regulates the fan speed by way of a virtual wall at the front edge of the extractor hood. A time-dependent circuit turns off the lamps again and reduces the fan speed after a certain period.

The disadvantage to these devices is that they make extractor hoods more expensive, and require additional user programming. This is why an operating state often becomes a permanent state once set, and the achievable energy effect is lost.

BRIEF SUMMARY OF THE INVENTION

The object of the invention is to make a work surface under an extractor hood gradually adjustable in an easy manner.

In the work surface lighting under an extractor hood according to the invention, in which at least two lamps are located for lighting the work surface and can be switched on and off with a switch, it is provided that the user be able to directly switch one or more lamps on and off using a light switch arranged on the extractor hood, and that one or more additional lamps are switched on or off via a switch that can be actuated by starting up/shutting down the extractor hood.

This device provides for a work surface lighting under an extractor hood that can be incrementally adjusted without any problem by the user in a very simple manner.

DETAILED DESCRIPTION OF THE INVENTION

Figure 1:
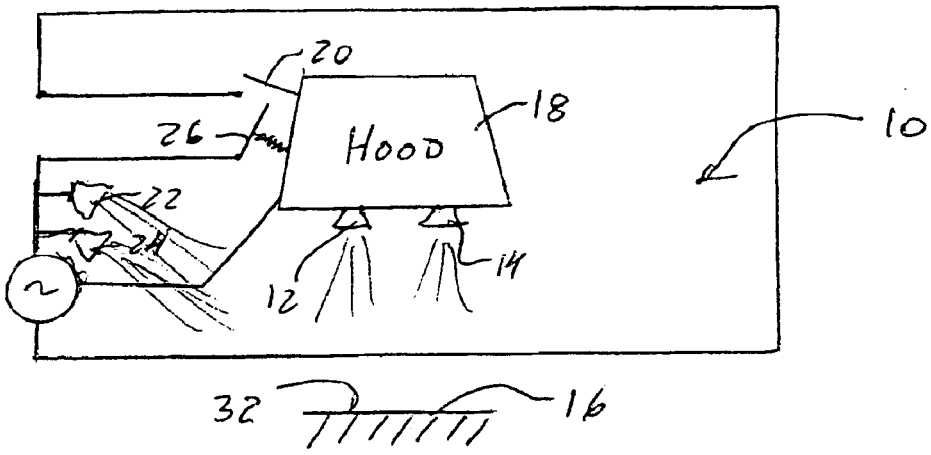
FIG. 1 is a diagrammatic illustration of a first embodiment of the present invention.

Referring to FIG. 1, in the work surface lighting system, designated generally by the numeral 10, at least two lamps 12, 14 are utilized for lighting a work surface 16. The lamps 12, 14 are located in an extractor hood 18 located above the work surface 16. The lamps 12, 14 can be switched on and off with a switch 20 by a user. The user can directly switch one or more of the lamps 12, 14 on and off using the light switch 20 arranged on the extractor hood 18. The user can switch one or more additional lamps 22, 24 on or off via a switch 26 that can be actuated by starting up/shutting down the extractor hood 18.

In one preferred embodiment, the switch 26 coupled with the startup/shutdown of the extractor hood 18 can be actuated by retracting or inserting an extraction unit (not illustrated) that improves the exhaust function of the extractor hood 18.

Figure 2:
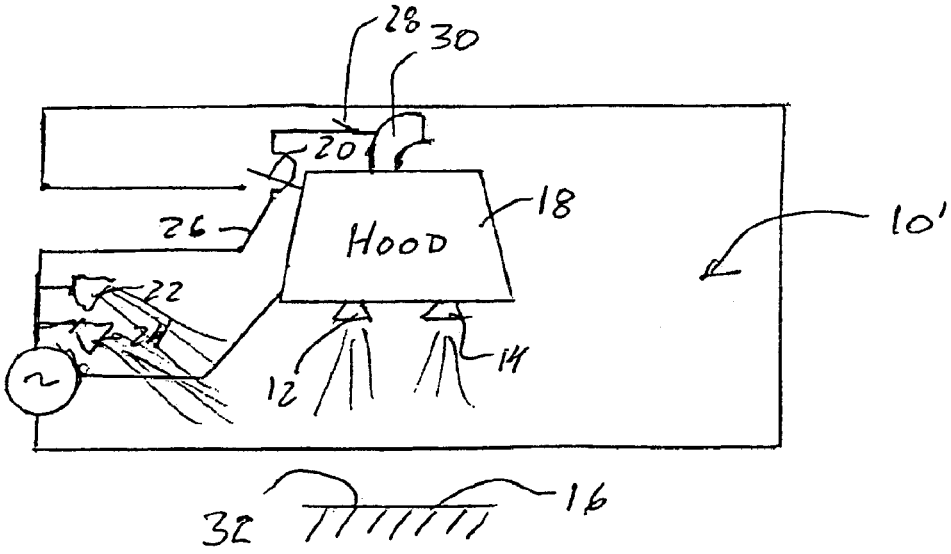
FIG. 2 is a diagrammatic illustration of a second embodiment of the present invention.

In another variant 10', referring to FIG. 2, the switch 26 coupled with the startup/shutdown of the extractor hood 18 can be actuated by an on/off switch 28 of an exhaust hood fan 30.

During the process of cooking and concurrent venting, both embodiments ensure a complete lighting of a cooking surface 32, which can be the work surface 16 under the extractor hood 18.

Figure 3:
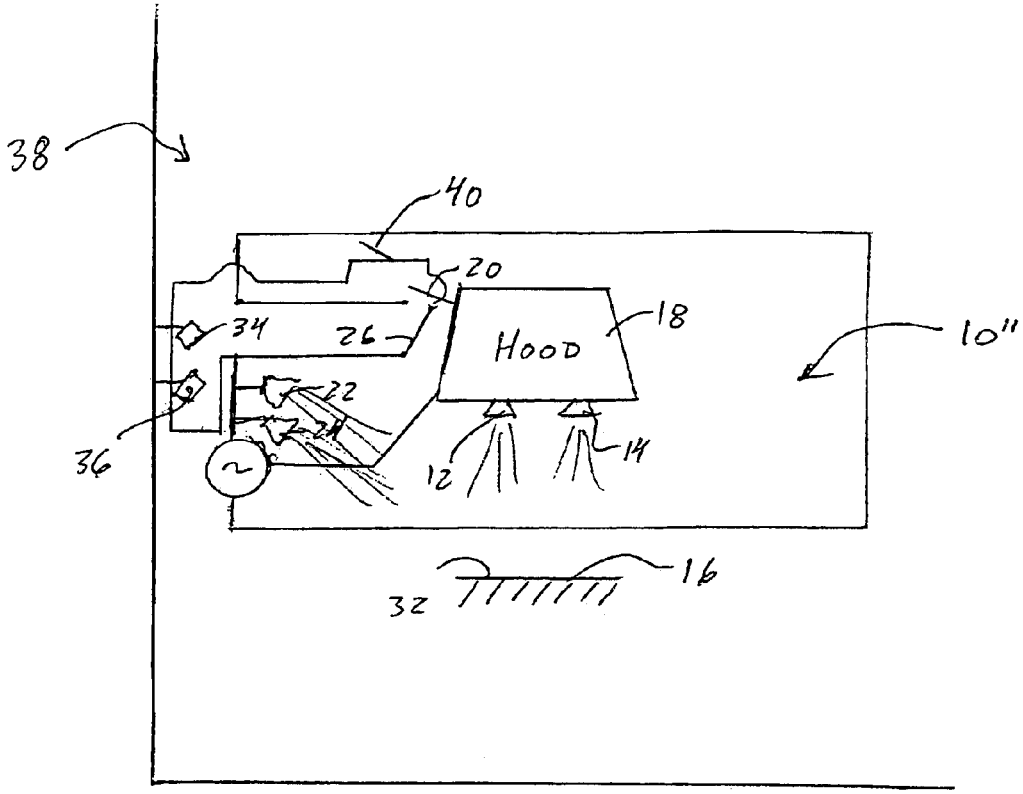
FIG. 3 is a diagrammatic illustration of a third embodiment of the present invention.

It is also possible in an embodiment 10", referring to FIG. 3, to use one or more lamps 34, 36 to be switched on and off by the user for lighting a room 38, with a switch 40.

Figure 4:
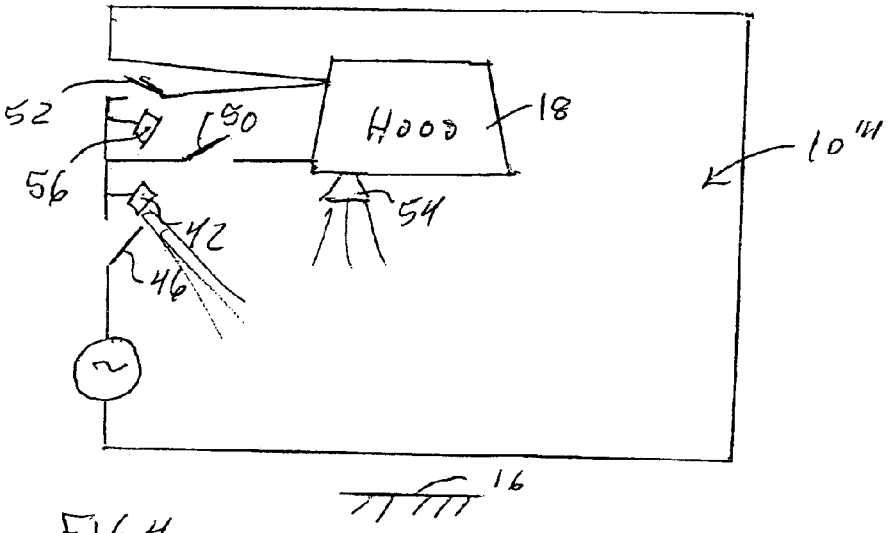
FIG. 4 is a diagrammatic illustration of a further embodiment of the present invention.

To ensure that a lamp 42 to be switched on and off by the user is always switched on first, the invention provides an embodiment 10''', referring to FIG. 4, in which a switch 46 for the lamp 42 to be operated directly by the user is wired with a pair of switches 50, 52 with respective lamps 54, 56 that can be actuated during startup/shutdown. The switch 46 is wired in such a way that it being switched on is a precondition for actuating the activation function of the other switch(es) 50, 52. In this way, the lighting can be completely deactivated given sufficient daylight.

In addition, one preferred embodiment provides that the light switch, such as the switch 46 in FIG. 4, that the user can directly switch on and off, and/or the switch, such as one of the switches 48, 50 in FIG. 4 that can be actuated by starting up/shutting down the extractor hood 18, includes a dimming function for gradually adjusting the luminous intensity of the lamp(s) actuated with the respective switch. This makes it possible to set any illumination intensity under the extractor hood 18.

What is claimed is:

1. A work surface lighting arrangement for lighting the work surface under an extractor hood, comprising:

at least a first and a second light located in said extractor hood;

at least said first light having a user directly operated on and off switch located on said extractor hood; and at least said second light having an on and off switch actuatable by the starting up or shutting down of said extractor hood.

2. The arrangement according to claim 1, including said second light on and off switch actuatable by an on off switch of an exhaust fan of said extractor hood.

3. The arrangement according to claim 2, including said first light user operated on and off switch wired with said second light, such that said first light must be activated as a precondition for actuating said second light.

4. The arrangement according to claim 2, including at least one of said first and second lights including a dimming function for gradually adjusting the luminous intensity of said light.

5. The arrangement according to claim 1, including said first light user operated on and off switch wired with said second light, such that said first light must be activated as a precondition for actuating said second light.

6. The arrangement according to claim 5, including at least one of said first and second lights including a dimming function for gradually adjusting the luminous intensity of said light.

7. The arrangement according to claim 1, including at least one of said first and second lights including a dimming function for gradually adjusting the luminous intensity of said light.

* * * * *